US006082093A

United States Patent [19]

Greenwood et al.

[11] Patent Number: 6,082,093

[45] Date of Patent: Jul. 4, 2000

[54] COMBUSTION AIR CONTROL SYSTEM FOR A GAS TURBINE ENGINE

[75] Inventors: Stuart Greenwood, San Diego; Jorge Montoya, Chula Vista; Mike Kelton, San Diego; Tony Fahme, Chula Vista, all of Calif.

[73] Assignee: Solar Turbines Inc., Peoria, Ill.

[21] Appl. No.: 09/085,626

[22] Filed: May 27, 1998

[51] Int. Cl.[7] ..... F02C 9/18

[52] U.S. Cl. ..... 60/39.23; 60/39.29

[58] Field of Search ..... 60/39.23, 39.29

[56] References Cited

U.S. PATENT DOCUMENTS

| | | | |
|---|---|---|---|
| 4,255,927 | 3/1981 | Johnson et al. | 60/39.23 |
| 5,638,674 | 6/1997 | Mowill | 60/39.23 |

FOREIGN PATENT DOCUMENTS

| | | | |
|---|---|---|---|
| 0281961A1 | 9/1988 | European Pat. Off. | F23R 3/26 |
| 0547808A1 | 6/1993 | European Pat. Off. | F23R 3/26 |
| 663639 | 12/1951 | United Kingdom . | |
| 695342 | 8/1953 | United Kingdom . | |
| WO98/23902 | 6/1998 | WIPO | F23R 3/26 |

*Primary Examiner*—Timothy S. Thorpe
*Assistant Examiner*—Ehud Gartenberg
*Attorney, Agent, or Firm*—Larry G. Cain

[57] ABSTRACT

Systems for controlling the combustion air to be used with a gas turbine engine for control the products of combustion and reducing emissions emitted therefrom have been used in the past. The present system includes a compressed air plenum being divided into a combustion air supply portion and a dilution or cooling air supply portion. A variable geometry system is positioned between the compressor section and the compressed air plenum. The variable geometry system is movably between an open position and a closed position. Movement of the variable geometry system varies the distribution of the compressed air between the combustion air supply portion and the dilution or cooling air supply portion. The system reduces emissions emitted from the gas turbine engine.

16 Claims, 4 Drawing Sheets

COMBUSTION AIR CONTROL SYSTEM FOR A GAS TURBINE ENGINE

TECHNICAL FIELD

This invention relates generally to a gas turbine engine and more particularly to a system for controlling the distribution of air between combustion air and dilution or cooling air.

BACKGROUND ART

The use of fossil fuel in gas turbine engines results in combustion products within the exhaust. These combustion products consist of carbon dioxide, water vapor, oxides of nitrogen, carbon monoxide, unburned hydrocarbons, oxides of sulfur and particulates. Of these above products, carbon dioxide and water vapor are generally not considered objectionable. In most applications, governmental imposed regulations are further restricting the remainder of the species, mentioned above, emitted in the exhaust gases.

The majority of the products of combustion emitted in the exhaust can be controlled by design modifications, cleanup of exhaust gases and/or regulating the quality of fuel used. For example, particulates in the engine exhaust have been controlled either by design modifications to the combustor and fuel injectors or by removing them by traps and filters.

The principal mechanism for the formation of oxides of nitrogen involves the direct oxidation of atmospheric nitrogen. The rate of formation of oxides of nitrogen by this mechanism depends mostly upon the flame temperature and, consequently, a small reduction in flame temperature can result in a large reduction in the nitrogen oxides.

Attempts to control NOx emissions by regulating the local flame temperature have adopted the use of water or steam injection. This system increases cost due to the additional equipment, such as pumps, lines and storage reservoir. Furthermore, in areas where a supply of water is not readily available the cost and labor to bring in water basically makes this option undesirable.

In an attempt to reduce NOx emissions without incurring increase in operational cost caused by water or steam injection, gas turbine combustion systems have utilized a variety of approaches including premix systems and various fuel injector designs. These premix system and injectors used therewith are examples of attempts to reduce the emissions of oxides of nitrogen. The systems and injectors described above although reducing the emissions of oxides of nitrogen emitted from the engine exhaust still produce significant amounts of oxides of nitrogen in the engine exhaust.

As stated above, NOx typically forms in high temperature environments. Two ways of solving this problem each involve reducing the temperature of combustion. For example, exhaust gas recirculation (EGR) reduces the flame temperature during combustion. Another solution, used mainly in gas turbines, increases the air flow into the combustor reaction zone. Hence, reducing flame temperature of oxides of nitrogen.

The present invention is directed to overcome one or more of the problems as set forth above.

DISCLOSURE OF THE INVENTION

In one aspect of the invention, a gas turbine engine has a compressor section establishing a flow of compressed air, a source of fuel and a combustion section. The gas turbine engine is comprised of a fuel injector, a compressed air plenum being divided into a combustion air supply portion and a dilution or cooling air supply portion. A variable geometry system is positioned between the compressor section and the compressed air plenum. The variable geometry system is movably between a closed position and an open position. And, movement of the variable geometry system between the closed position and the open position varies the distribution of compressed air to the combustion air supply portion and to the dilution or cooling air supply portion.

In another aspect of the invention a method of cooling a combustor liner is comprised of the following steps. Establishing a flow of compressed air. Dividing the flow of compressed air between a combustion air supply portion and a dilution or cooling air supply portion. Using at least a portion of the flow of combustion air being divided into the combustion air supply portion for cooling the combustor liner. And, directing the flow of combustion air divided into the combustion air supply portion after cooling the combustor liner into a fuel mixing cavity.

In another aspect of the invention a system for reducing emissions emitted from a gas turbine engine is disclosed. The gas turbine engine has a compressor section establishing a flow of compressed air, a source of fuel and a combustion section. The system for reducing emissions is comprised of a fuel injector defining a combustion air inlet. A compressed air plenum is divided into a combustion air supply portion and a dilution or cooling air supply portion. A variable geometry system is positioned between the compressor section and the compressed air plenum. The variable geometry system is movably between a closed position and an open position. The combustion air supply portion is sealed from the dilution or cooling air supply portion. A movement of the variable geometry system between the closed position and the open position varies the distribution of compressed air to the combustion air supply portion and to the dilution or cooling air supply portion. And, the distribution of compressed air being varied to the combustion air supply portion all being used to support combustion in the gas turbine engine.

BEST MODE FOR CARRYING OUT THE INVENTION

Figure 1:
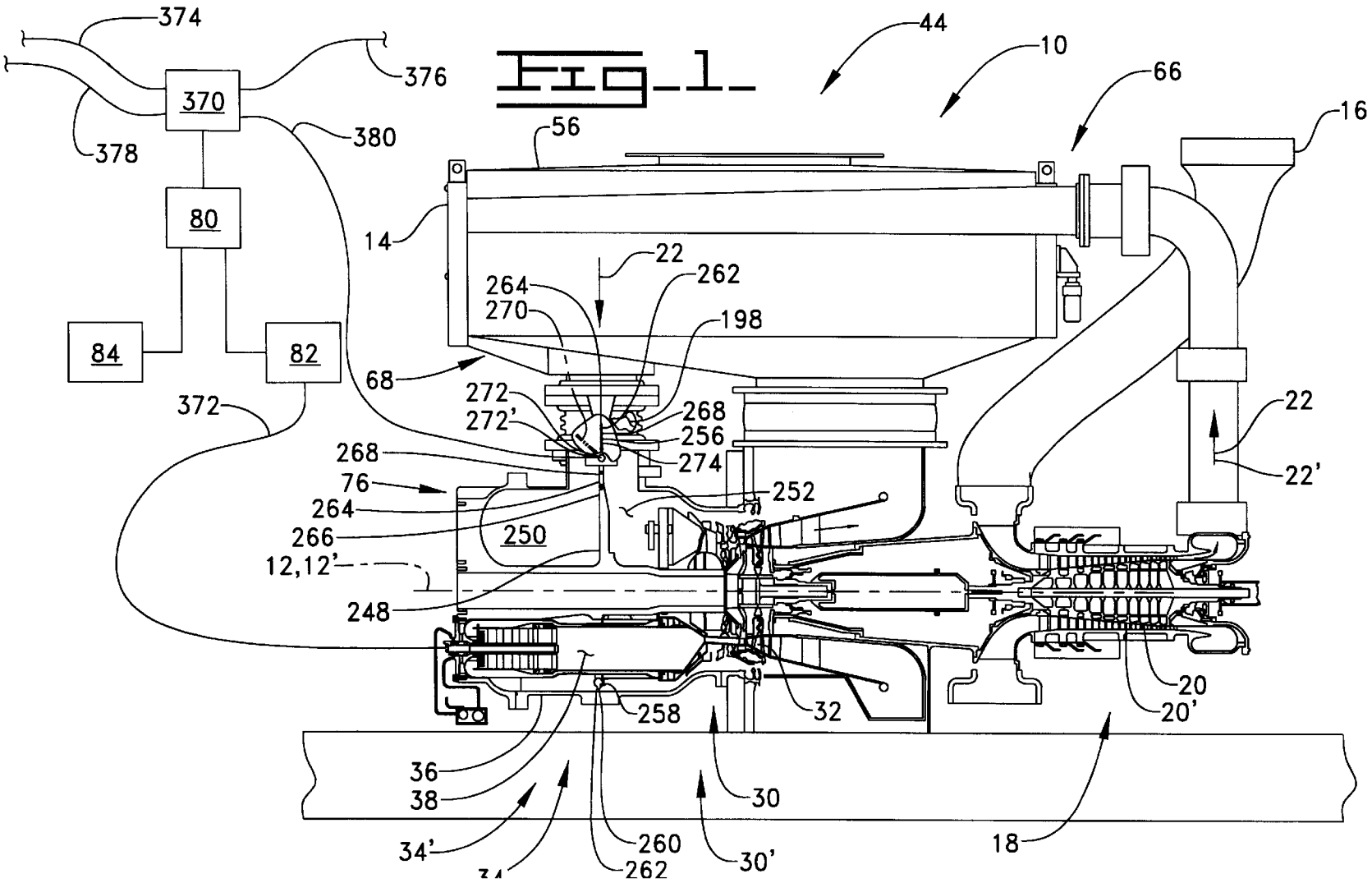
FIG. 1 is a partially sectional view of a gas turbine engine embodying the present invention.
Figure 2A:
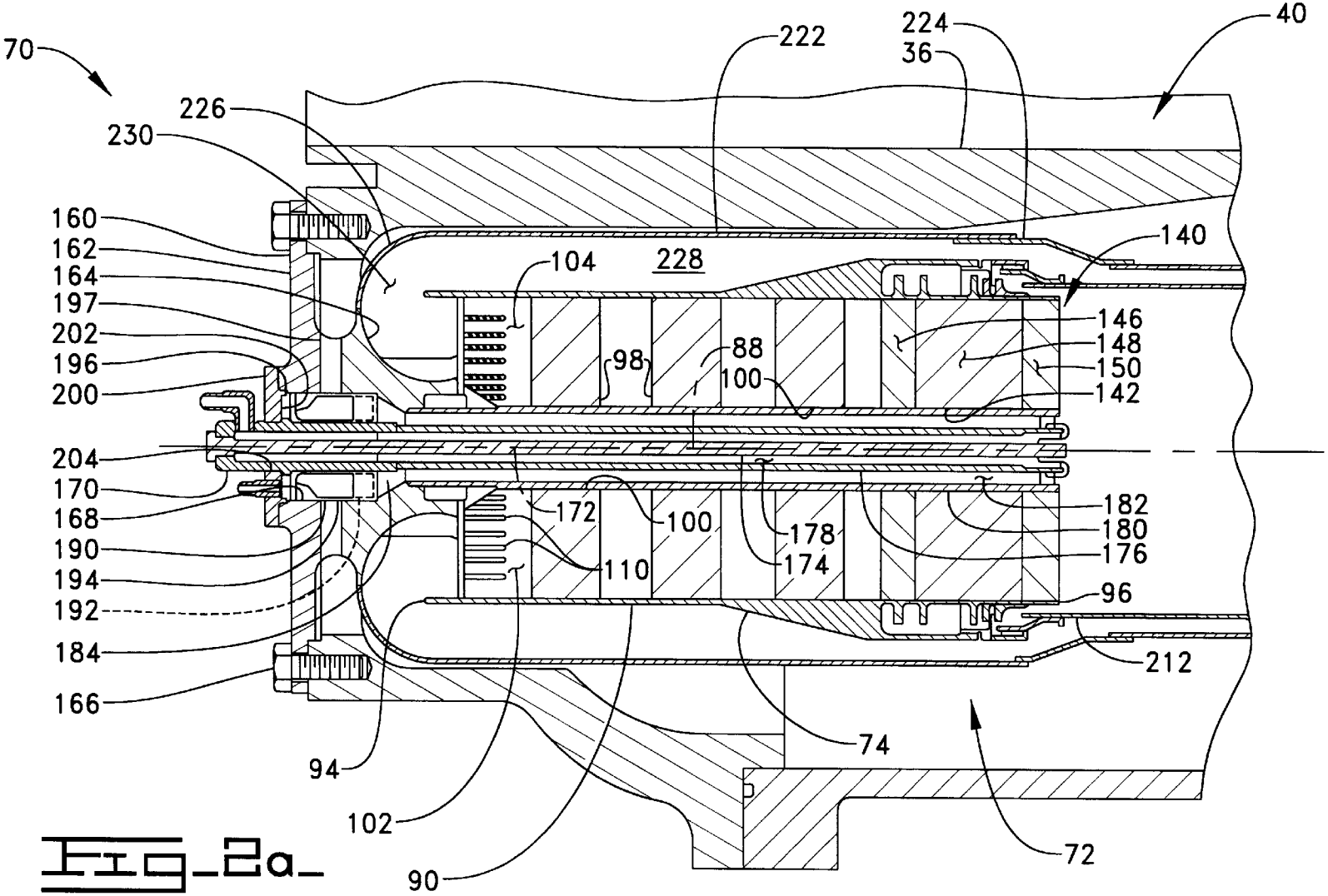
FIG. 2*a* is an enlarged sectional view of a portion of the gas turbine engine embodying the present invention applied to a catalytic combustion system.
Figure 2B:
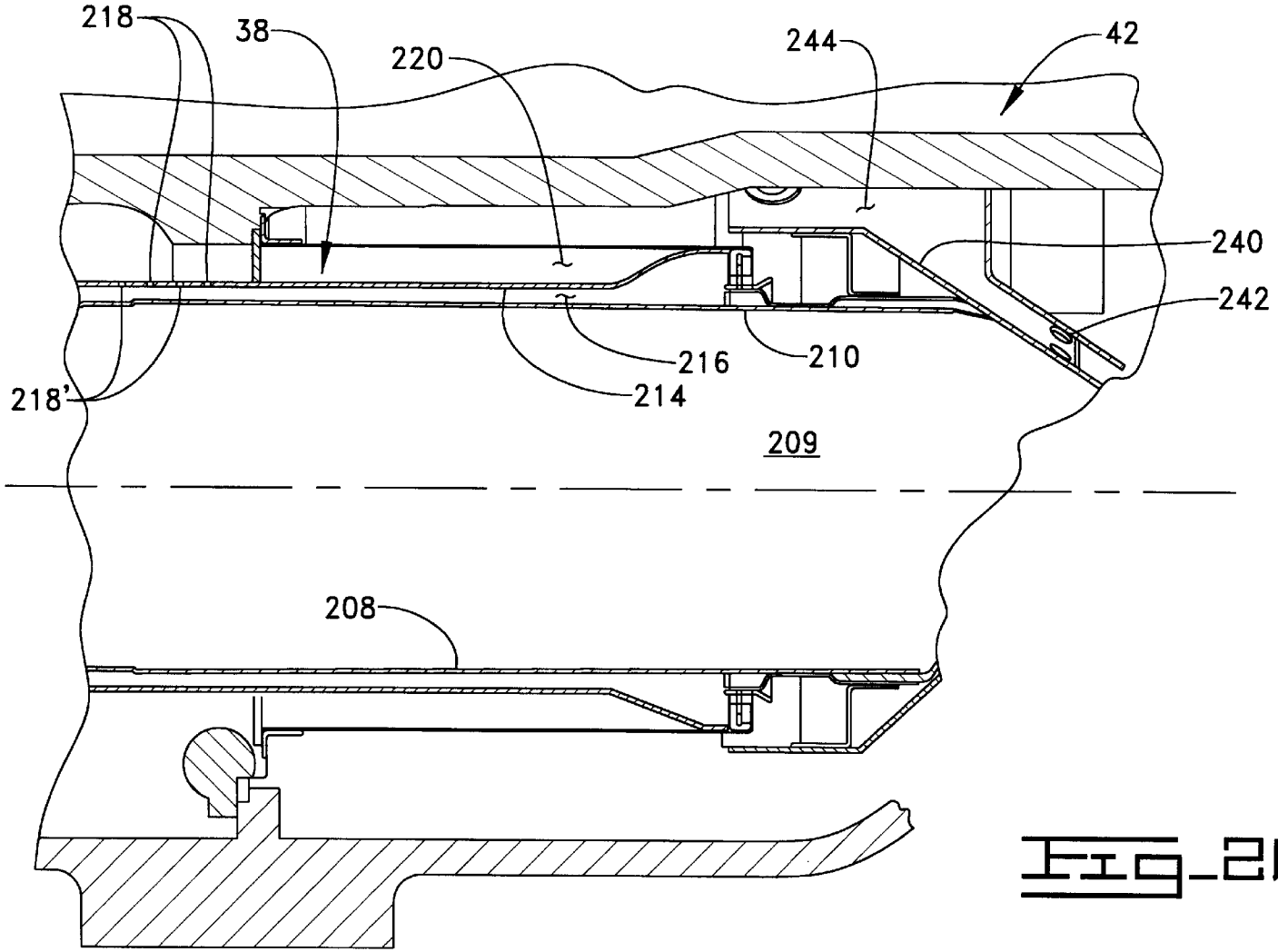
FIG. 2*b* is an enlarged sectional view of a portion of the gas turbine engine embodying the present invention applied to a catalytic combustion system.

Referring to FIGS. 1, 2*a* and 2*b*, a gas turbine engine 10 is shown. The gas turbine engine 10 defines a central axis 12, a front 14 and a rear 16. The front 14 and the rear 16 form a portion of an exterior of the gas turbine engine 10 being readily assessable. Interposed the front 14 and the rear 16 of the gas turbine engine 10 are a compressor section 18 having a plurality of compressor components 20 therein to establish a flow of compressed air 22. A turbine section 30 having a plurality of turbine components 32 is also interposed the front 14 and the rear 16. The compressor section 18 and the turbine section 30 are operatively connected one to the other. A combustor section 34, as best shown in FIGS. 2*a* and 2*b*, defines a housing 36 having a plurality of can combustors 38 being radially spaced about the axis 12 and operatively connected to the turbine section 30 positioned therein. As an alternative, a single combustor could be use or the location and placement of the plurality of can combustors 38 could be altered. Each of the plurality of can combustors 36 have an inlet end portion 40 communicating with the compressor section 18 and an outlet end portion 42 communicating with the turbine section 30. The gas turbine engine 10 further includes a system 44 for controlling a quantity of the combustion air for use with the gas turbine engine 10 to support combustion.

In this application, a primary surface recuperator 56 defines a plurality of donor passages having an inlet portion operatively connected to the turbine section 30. A donor fluid exits the turbine section 30 and passes through the plurality of donor passages in the recuperator 56 prior to exiting the recuperator 56. The recuperator 56 further defines a plurality of recipient passages having a inlet end portion 66 and an outlet end portion 68. A recipient fluid exits the compressor section 18 and operatively passes through the plurality of recipient passages, the outlet end portion 68 and enters into the combustor section 34.

As further shown in FIGS. 2*a* and 2*b*, a catalytic combustion system 70 is adapted for use with individual ones of the plurality of can combustors 38. The catalytic combustion system 70 is comprised of a catalytic combustor 72, which in this application, includes a compact catalytic combustor-module 74. The catalytic combustion system 70 is further adapted for use with a variable geometry system 76, best shown in FIGS. 1 and 3. The catalytic combustion system 70 is positioned between the outlet end portion 68 of the plurality of recipient passages of the recuperator 56 and the plurality of can combustors 38 of the combustor section 34. The catalytic combustion system 70 is further adapted for use with an operations system 80 including a start-up system 82 and an operating system 84.

As best shown in FIGS. 2*a* and 2*b*, the compact catalytic combustor-module 74 defines an axis 88 and includes a housing 90. In the preferred embodiment, the housing 90 has a cylindrical configuration centered about the axis 88 and defines a first end 94 and a second end 96. Interposed the first end 94 and the second end 96 of the housing 90 is a plurality of mixers 98. Each of the plurality of mixers 98 is spaced one from another a preestablished distance and has an inner bore 100 being positioned therein and centered about the axis 88. Positioned between the plurality of mixers 98 and the first end 94 is a fuel mixing cavity 102. The fuel mixing cavity 102 defines a combustion air inlet 104. Positioned in the fuel mixing cavity 102 is a plurality of fuel injectors or nozzles 110. The plurality of fuel nozzles 110 are in communication with a source of fuel, not shown. A catalyst bed 140 is positioned between the plurality of mixers 98 and the second end 96 of the housing 90. The catalyst bed 140 has a cylindrical configuration and defines an inner bore 142 therein. The catalyst bed 140 is spaced from the plurality of mixers 98 and including a first retainer 146, a plurality of catalyst 148 and a second retainer 150. As an alternative, a single catalyst could be used with the plurality of can combustors 38. As a further alternative, a single catalyst without the retainer could be used.

A mounting plate 160 is a part of the compact catalytic combustor-module 74 and is attached near the first end 94 of the housing 90. The mounting plate 160 defines a first side 162 and a second side 164. A plurality of fastener 166 removably attach the mounting plate 160 and the compact catalytic combustor-module 74 to each of the plurality of can combustors 38 in a conventional manner. The mounting plate 160 further includes an inner bore 168. Positioned within the inner bore 142 of the catalyst bed 140, the inner bore 92 of the plurality of mixers 98 and the inner bore 168 of the mounting plate 160 is a part load fuel injector 170.

The part load fuel injector 170 has a generally cylindrical configuration and defines a central axis 172 being synonymous with the axis 88 of the compact catalytic combustor-module 74. Centered about the central axis 172 is an igniter 174 of conventional construction. Spaced from the igniter 174 a preestablished radial distance is a first cylindrical wall 176 defining a fuel cavity 178 between the first cylindrical wall 176 and the igniter 174. The fuel cavity 178 is in communication with a source of fuel, not shown. Spaced from the first cylindrical wall 176 a preestablished radial distance is a second cylindrical wall 180 defining an air cavity 182 between the second cylindrical wall 180 and the first cylindrical wall 176. The air cavity 182 defines a combustion air inlet 184. Each of the fuel cavities 178 and the air cavities 182 meet and are mixed within the part load fuel injector 170 prior to entering the combustor section 34. The second cylindrical wall 180 is attached to the second side 164 of the mounting plate 160. The air cavity 182 further extends an axial distance between the first cylindrical wall 176, along the inner bore 168 of the mounting plate 160 and to the first side 162 of the mounting plate 160. A valve 190 is positioned within the axial distance of the air cavity 182 between the first cylindrical wall 176 and the inner bore 168 of the mounting plate 160. The valve 190 moves axially between an open position 192, as shown in phantom, and a closed position 194. As an alternative, the operation of the valve 190 could be of a radial or other motion verses the axial motion disclosed in this application. An actuator 196 biases the valve 190 into the open position 192. An inlet passage 197 communicates with a compressed air plenum 198, best shown in FIGS. 1 and 3. When the valve 190 is in the open position 192, the inlet passage 197 communicates with the air cavity 182. The inlet passage 197 is positioned in the mounting plate 160. A header plate 200 is removably attached to the first side 162 of the mounting plate 160 in a conventional manner. The header plate 200 defines a sealing side 202 being positioned in sealing relationship to the air cavity 182. A central bore 204 of the header plate 200 is positioned in sealing relationship with the first cylindrical wall 176 of the part load injector 170. The actuator 196 is positioned between the valve 190 and the header plate 200.

The axis 88 of each of the plurality of can combustors 38 is symmetrical with the central axis 172 of the part load fuel injector 170. Each can combustor 38 includes a combustor liner 208 being radially spaced about the axis 88 and defining a combustion zone 209. The combustor liner 208 has a generally cylindrical configuration. The combustor liner 208 defines a first end portion or hot end portion 210 and a second end portion or cold end portion 212 being connected to the second end 96 of the housing 90 of the compact catalytic combustor-module 74. The first end portion 212 communicates with the turbine section 30. Radially spaced from the combustor liner 208 is an impingement shield 214 defining a passage 216 interposed the impingement shield 214 and the combustor liner 208. The impingement shield 214 has a generally cylindrical configuration and includes a plurality of through passages 218 positioned therein which communicate with the flow of compressed air 22. Furthermore, an air passage 220 is located between a portion of the housing 36 and the impingement shield 214. The air passage 220 is in communication with the flow of compressed air 22 from the compressor section 20. A shield 222 is positioned within the housing 36. The shield 222 defines a first end 224 being positioned about the second end 212 of the impingement shield 214 and a second end 226 having a radial configuration being connected to the second side 164 of the mounting plate 160. The shield 222 provides a further extension of the impingement shield 214 but is void of the plurality of through passages. The passage 216 further extends into an axial area 228 formed between a portion of the shield 222 and the housing 90 of the compact catalytic combustor-module 74. The passage 216 further includes a radial portion 230. The radial portion 230 extends between the second end 226 of the shield 222 and the second side 164 of the mounting plate 160, and the first end 94 of the housing 90 of the compact catalytic combustor-module 74. The passage 216 communicates with the a fuel mixing cavity 102. A dilution shield 240 is connected to the first end 210 of the combustor liner 208. The dilution shield 240 includes a plurality of dilution holes 242 defined therein. A dilution passage 244 is formed between a portion of the housing 36 of the combustor section 34 and the dilution shield 240. The dilution passage 244 communicates with the flow of compressed air 22 from the compressor section 20.

The variable geometry system 76 portion of the system 44 is equally applicable to any low emission lean premixed combustor. The variable geometry system 76 can be used with a low emission lean premixed annular combustor or a multi-can design without changing the jest of the invention. The variable geometry system 76 includes the compressed air plenum 198. The compressed air plenum 198, in this application, is interposed the outlet end portion 68 of the primary surface recuperator 56 and the combustor section 34. As an alternative, for a engine being void of a recuperator, the compressed air plenum 198 could be located between the compressor section 20 and the combustor section 34.

And, as best shown in FIG. 1, the variable geometry system 76 is positioned in the compressed air plenum 198. A separator plate 248 divides the compressed air plenum 198 into a combustion air supply portion 250 and a dilution or cooling air supply portion 252. For example, the separator plate 248 defines an upper division portion 256 and a lower division portion 258 being interposed the combustion air supply portion 250 and the dilution or cooling air supply portion 252. The upper division portion 256 and the lower division portion 258 each define an outer perimeter 260 having a seal 262 positioned therein. The seal 262, in most of its application, is in sealing relationship with the housing 36. Thus, the flow of compressed air 22 within each of the combustion air supply portion 250 and the dilution or cooling air supply portion 252 is sealed one from the other. The upper division portion 256 includes a diverter valve 264 includes a divider mechanism 266 being movable between an open position 268 and a closed position 270, shown in phantom. A control mechanism 272 is connected to the divider mechanism 266 and operatively moves the divider mechanism 266 through an arcuate motion including a plurality of preestablished positions between the open position 268 and the closed position 270. The divider mechanism 266 is infinitely movable. In the open position 268, the compressed air 22 is distributed between the combustion air supply portion 250 and the dilution or cooling supply portion 252. In this application, the air distribution is about ⅔ being used for combustion and about ⅓ being used for cooling/dilution. With divider mechanism 266 interposed the open position 268 and the closed position 270, a greater quantity of compressed air 22 is supplied to one of the combustion air supply portion 250 or the dilution or cooling supply portion 252. To further control and modulate the distribution of the flow of compressed air 22 between the combustion air supply portion 250 and the dilution or cooling air supply portion 252, a plurality of holes or openings 174 can be provided in the divider mechanism 266.

And, as an alternative, shown in FIGS. 1 and 3, the variable geometry system 76 is defined as follows. Like element are designated by a like numbers having a prime (') added thereto. A housing 36' of a combustor section 34' defines a compressed air plenum 198'. A mounting plate 160' is attached to the housing 36'. The mounting plate 160' in this alternative includes a center housing 280 being center on the central axis 12'. A first end 282 of the mounting plate 160' is attached to a turbine section 30' and a second end 284 is spaced from the first end 282. A flange member 286 is attached to the second end 284 and radially extends to an outer mounting flange 288. A plurality of fasteners 166' removably connect the mounting plate 160' to the housing 36'. A plurality of fuel injector holes 289 are radially spaced about the axis 12' and are positioned in the flange member 286. Interposed the first end 282 and the second end 284 is a separator plate 248'. The separator plate 248' divides the compressor air plenum 198' into a combustion air supply portion 250' and a dilution or cooling air supply portion 252'. For example, the separator plate 248' defines an upper division portion 256' and a lower division portion 258' being interposed the combustion air supply portion 250' and the dilution or cooling air supply portion 252'. The upper division portion 256' and the lower division portion 258' each define an outer perimeter 260' having a seal 262' positioned therein. The seal 262', in most of its application, is in sealing relationship with the housing 36'. Thus, the flow of compressed air 22' within each of the combustion air supply portion 250' and the dilution or cooling air supply portion 252' is sealed one from the other. The upper division portion 256' has a diverter valve 264' attached thereto for distributing the quantity of compressed air 22 being supplied to each of the combustion air supply portion 250' and the dilution or cooling air supply portion 252'. As an alternative, other means could be used to distribute the flow of compressed air between the air supply portion 250' and the dilution supply portion 252', such as a variable orifice.

In this alternative, the combustor section 34' includes an annular combustor 290 positioned in the dilution or cooling air supply portion 252'. The annular combustor 290 defines an inlet end portion 292 and an outlet end portion 294. The annular combustor 290 includes an inner annular wall 296 having an inlet end 298 and an outlet end 300. An outer annular wall 302 has an inlet end 304 and an outlet end 306. A first end 310 of an inner annular flange member 312 is attached to the inlet end 298 of the inner annular wall 296. A second end 314 of the inner annular flange member 312 is spaced from the first end 310 a preestablished distance and extends beyond the inlet end 298 of the inner annular wall 296. A plurality of passages 316 are annularly positioned within the inner annular flange member 312 between the first end 310 and the second end 314. A first end 320 of an outer annular flange member 322 is attached to the inlet end 304 of the outer annular wall 302. A second end 324 of the outer annular flange member 322 is spaced from the first end 320 a preestablished distance and extends beyond the inlet end 304 of the outer annular wall 302. A plurality of passages 326 are annularly positioned within the outer annular flange member 322 between the first end 320 and the second end 324.

A combustor plate 328 is positioned at the inlet end portion 292 and is interposed the outer annular wall 302 and the inner annular wall 298. The combustor plate 328 is attached to each of the inlet end 298 of the inner annular wall 296 and to the inlet end 304 of the outer annular wall 302. A plurality of fuel injector holes 330 are positioned in the combustor plate 322 and radially extend about the axis 12'. Spaced from the inner annular wall 296 a preestablished distance is an inner shield 332 defining a first end 334 being connected to the inner annular flange member 312 between the first end 310 and the plurality of passages 326. And, a second end 336 is connected to the inner annular wall 296 near the outlet end 300. The preestablished distance between the inner annular wall 296 and the inner shield 332 forms a portion of a cooling passage 216'. Spaced from the outer annular wall 302 at a preestablished distance is an outer shield 338 defining a first end 340 being connected to the outer annular flange member 322 between the first end 320 and the plurality of passages 326. And, a second end 342 is connected to the outer annular wall 302 near the outlet end 306. The preestablished distance between the outer annular wall 302 and the outer shield 338 forms another portion of the cooling passage 216'.

A plurality of fuel injectors 350 are sealingly positioned within respective ones of the plurality of fuel injector holes 289 in the mounting plate 160' and the plurality of fuel injector holes 330 in the combustor plate 328. Each of the plurality of fuel injectors 350 includes a pilot fuel passage, not shown, being in communication with a source of fuel, not shown. And, an air passage 352 having a combustion air inlet 354 being in communication with the flow of compressed air 22 within the combustion air supply portion 250'. The air and the fuel are mixed and enter the combustion zone 209' wherein an igniter 174', which in this alternative is a torch igniter, is activated and combustion occurs. Each of the plurality of fuel injectors 350 further includes a primary fuel passage, not shown. And, a primary air passage 356 having a combustion air inlet 358 being in communication with the flow of compressed air 22 within the combustion air supply portion 250'.

Figure 3:
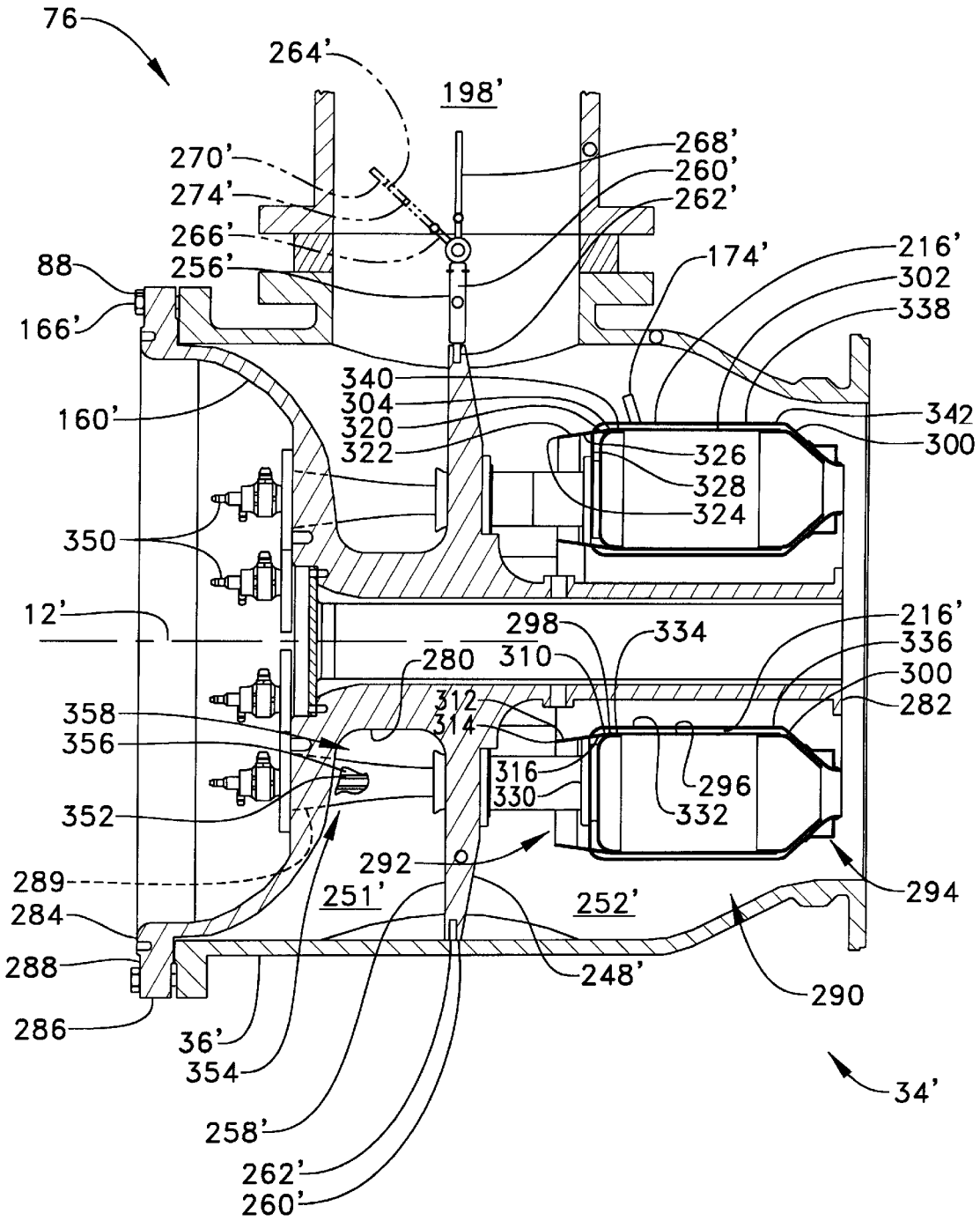
FIG. 3 is an enlarged sectional view of a portion of the gas turbine engine having a lean premixed combustion system therein.

In this alternative, and further shown in FIG. 3, the diverter valve 264' includes a divider mechanism 266' being movable between an open position 268', shown in phantom, and a closed position 270'. A control mechanism 272', as best shown in FIG. 1, is connected to the divider mechanism 266' and operatively moves the divider mechanism 266' through an arcuate motion including a plurality of preestablished positions between the open position 268' and the closed position 270'. The divider mechanism 266' is infinitely movable. In the open position 268', the compressed air 22 is distributed between the air supply portion 250' and the dilution or cooling supply portion 252'. With divider mechanism 266' interposed the open position 268' and the closed position 270', a greater quantity of compressed air 22 is supplied to one of the combustion air supply portion 250 and the dilution or cooling supply portion 252'. To further control and modulate the distribution of the flow of compressed air 22 between the combustion air supply portion 252', a plurality of holes or openings 274' can be provided in the divider mechanism 266'.

The operations system 80, as defined earlier and best shown in FIG. 1, includes the start-up system 82 and the operating system 84. The operating system 80 is controlled by an on-board computer 370 which stores a plurality of input signals. As an alternative, the computer 370 could be located at a remote location or could include another programmable system such as magnetic tapes, digital tapes or manually operated. A plurality of input signals are interpreted, analyzed, deciphered and, if necessary, stored for future use to define a plurality of operating parameters of the gas turbine engine 10. For example, input signals are obtained for temperatures, pressures and speed within at least a portion of the compressor section 20,20', the combustor section 34,34' and the turbine section 30,30'.

The start-up system 82 includes a start-up mode which has a set of preestablished parameters stored within the on-board computer 370. A first signal 372 communicates between the on-board computer 370 and the igniter 174,174'. A second signal 374 communicates from the on-board computer 370 to provide fuel to the fuel cavity 178 in the part load fuel injector 170 or the fuel passage in the fuel injector 350. And, a third signal 376 communicates from the on-board computer 370 to rotate the compressor section 34 establishing the flow of compressed air 22.

The operating system 84 includes a part load operating mode and a full load operating mode, each having a set of preestablished parameters stored within the on-board computer 370. In the part load operating mode, a first signal 378 communicates from the on-board computer 370 to provide fuel to the plurality of fuel passages 132 in the separator plate 120 or the primary fuel passage in the fuel injector 350. And, a second signal 380 communicates from the on-board computer 370 to the control mechanism 272,272' to move the divider mechanism 266,266' between the open position 268,268' and the closed position 270,270'. In the full load operating mode, the first signal 378 communicates from the on-board computer 370 to provide fuel to the fuel mixing cavity 102 or the primary fuel passage in the fuel injector 350. And, the second signal 380 communicates from the on-board computer 370 to the control mechanism 272,272' to move the divider mechanism 266,266' between the open position 268,268' and the closed position 270,270'. The primary difference between the part load operating mode and the full load operating mode is in the quantity of fuel provided and the degree or position of the travel of the divider mechanism 266,266'.

Industrial Applicability

In operation, the gas turbine engine 10 with the system 44 controls the products of combustion being emitted in the exhaust. The primary emission being controlled or reduced is the formation of NOx, CO and UHC. For example, the gas turbine 10 is started. Thus, the on-board computer 370 is actuated and the start-up system 82 is engaged. The rotation of the gas turbine engine 10 components, such as, the compressor section 18 begins. Compressed air 22 passes through the primary surface recuperator 56, past the diverter valve 264,264' within the compressed air plenum 198,198'. The compressed air 22 directed to the combustion air supply passage 250,250'. In the first embodiment, the compressed air 22 is directed to the cooling passage 216, passes through the plurality of through passages 218 into the passage 216 and travels axially along the combustor liner 208 from the first end portion 210 toward the second end portion 212 and into the axial area 228 along the housing 90. Thus, with the cooling air 22 passing from the first end portion (hot end) 210 to the second end portion (cold end) 212 the efficiency and the effectiveness of the cooling performed by the compressed air 22 is greatly increased. From the axial area 228, the compressed air 22 enters the combustion air inlet 104 of the fuel mixing cavity 102. The compressed air 22 flows through the plurality of mixers 98, the catalyst bed 140 and into the combustion zone 209.

In the second embodiment, the compressed air 22 within the dilution or cooling air supply portion 252' passes through the plurality of passages 316 in the inner annular flange member 302 and the plurality of passages 326 in the outer annular flange member 324. The compressed air 22 enters the portion of the passage 216' between the inner annular wall 296 and the inner shield 332 or the portion of the passage 216' between the outer annular wall 302 and the outer shield 338. Further in the second embodiment, the cooling air 22 passes from the inlet end portion (cold end) 292 toward the outlet end portion (hot end) 294 and cools the inner annular wall 296 and the outer annular wall 302. Also, compressed air 22 in the combustion air portion 250' enters the inlet portion 354 of the pilot air passage 352 and/or the inlet portion 358 of the primary air passage 356.

At the same time, fuel is delivered to the fuel cavity 178 of the part load fuel injector 170 in one embodiment. The valve 190 is moved into the open position 192 and compressed air 22 from the combustion air portion 250 is delivered to the air cavity 182. Thus, the fuel and the compressed air 22 exiting the part load fuel injector 170 are mixed and the igniter 174 is activated causing the gas turbine engine 10 to start.

And, in the second embodiment, fuel is delivered to the pilot fuel passage, exits the fuel injector 350 mixed with compressed air 22 and the igniter 174' is activated causing the gas turbine engine 10 to start.

After the gas turbine engine 10 has started, the operation system 80 is actuated by the on-board computer 370 and the start-up system 82 is disconnected in due time. With the operation system 80 in control, in the first embodiment, fuel is delivered to the plurality of nozzles 110 and is mixed within the fuel mixing cavity 102. Thus, the compressed air 22 therein mixes with the fuel and passes though the plurality of mixers wherein further mixing of the fuel and compressed air 22 occurs. After mixing, the fuel and compressed air 22 enters the catalyst bed 140. Within the catalyst bed 140 a reaction occurs to combust part of the fuel. The rest of the fuel is reacted in the combustor 209.

With the operating system 80 in control, in the second embodiment, fuel is delivered to the primary fuel passage in each of the plurality of fuel injectors 350 is and mixed with the compressed air 22 before entering the combustion zone 209. Although the present gas turbine engine 10 is primarily used at a constant speed, speed does not change with load. However, the present invention could also be used with a variable speed gas turbine engine 10 without changing the jest of the invention.

As the gas turbine engine 10 increases in speed and greater load is applied to the gas turbine engine 10, the operating system 84 takes full control over the operation of the gas turbine engine 10. For example, the start-up system 82 is turned off and discontinues to operation as a portion of the gas turbine engine operation system 80. For example, in the first embodiment, when the load applied to the gas turbine engine 10 reaches about 50 percent the operation of the part load fuel injector 140 is discontinued. Thus, the entire quantity of compressor air 22 and fuel used for combustion will pass through the catalyst bed 140. During the operation of the gas turbine engine 10 between about 50 percent load and 100 percent load the variable geometry system 76 is used to further control emissions emitted from the gas turbine engine 10. For example, as the gas turbine engine 10 load is decreased the quantity of compressor air 22 directed to the dilution or cooling air supply portion 252 is increased by the control mechanism 272. The divider mechanism 266 is moved toward the closed position 270. Thus, the quantity of compressed air 22 to the combustion air supply portion 250 is decreased and the quantity of compressed air 22 to the dilution or cooling air supply portion 252 is increased.

Additionally, in the second embodiment, when the load applied to the gas turbine engine 10 reaches about 50 percent the operation of the pilot portion of the fuel injector 350 is discontinued or the fuel flow is limited to a small percent of the total fuel flow. During the operation of the gas turbine engine 10 between about 50 percent load and 100 percent load the variable geometry system 76 is used to further control emissions emitted from the gas turbine engine 10. For example, as the gas turbine engine 10 load is decreased the quantity of compressor air 22 directed to the dilution or cooling air supply portion 252' is increased by the control mechanism 272. The divider mechanism 266 is moved toward the closed position 270. Thus, the quantity of compressed air 22 supplied to the combustion air supply portion 250' is decreased and the quantity of compressed air 22 supplied to the dilution or cooling air supply portion 252' is increased.

With the variable geometry system 76 adapted for use with the gas turbine engine 10 the emissions emitted from the gas turbine engine 10 is greatly reduced. Furthermore, with the variable geometry system 76, the entire operating range of the gas turbine engine 10 emissions emitted from the gas turbine engine 10 is controlled. For example, with the start-up system 82, start-up and part load operating conditions are controlled. And, with the operating system 84, the spectrum from part load to full load operating conditions are controlled.

Other aspects, objects and advantages of this invention can be obtained from a study of the drawings, the disclosure and the appended claims.

What is claimed is:

1. A gas turbine engine having a compressor section establishing a flow of compressed air, a source of fuel and a combustion section; said gas turbine engine comprising: a fuel injector, a compressed air plenum being divided into a combustion air supply portion and a dilution or cooling air supply portion; a variable geometry system that includes a control mechanism being connected to a divider mechanism having a plurality of holes or openings positioned therein, said system being positioned between said compressor section and said compressed air plenum, said variable geometry system being movable between an open position and a closed position; and a movement of said variable geometry system between said open position and said closed position varying the distribution of compressed air to said combustion air supply portion and to said dilution or cooling air supply portion.

2. The gas turbine engine of claim 1 wherein said wherein said combustion air supply portion and said dilution or cooling air supply portion are sealed one from the other.

3. The gas turbine engine of claim 1 wherein said movement includes a plurality of preestablished positions.

4. The gas turbine engine of claim 1 a wherein said combustor section includes one of a plurality of can combustors and an annular combustor.

5. The gas turbine engine of claim 1 wherein said gas turbine engine includes an operating system having a full load operating mode and a part load operating mode.

6. The gas turbine engine of claim 1 wherein said variable geometry system movement between said open position and said closed position increases said flow of compressed air to one of said combustion air supply portion and said dilution or cooling air supply portion.

7. The gas turbine engine of claim 6 wherein said variable geometry system movement between said open position and said closed position decreases said flow of compressed air to a corresponding one of said combustion air supply portion and said dilution or cooling air supply portion.

8. The gas turbine engine of claim 1 wherein said variable geometry system varying the distribution of compressed air to said combustion air supply portion and to said dilution or cooling air supply portion and said flow of compressed air varied to said combustion air supply portion being directed to a cooling passage prior to entering a fuel mixing cavity.

9. The gas turbine engine of claim 8 wherein said compressed air in said cooling passage being directed from a hot end portion to a cold end portion of a combustor liner.

10. The gas turbine engine of claim 1 wherein said variable geometry system varying the distribution of compressed air to said combustion air supply portion and to said dilution or cooling air supply portion and said flow of compressed air varied to said dilution or cooling air supply portion having at least a portion of said flow of compressed air being directed to an air passage prior to being directed into a combustion zone in said combustor section.

11. The gas turbine engine of claim 1 further including a recuperator.

12. A system for reducing emissions emitted from a gas turbine engine, said gas turbine engine having a compressor section establishing a flow of compressed air, a source of fuel and a combustion section; said system for reducing emissions comprising: a fuel injector defining a combustion air inlet, a compressed air plenum being divided into a combustion air supply portion and a dilution or cooling air supply portion; a variable geometry system that includes a control mechanism being connected to a divider mechanism having a plurality of holes or openings positioned therein, said system being positioned between said compressor section and said compressed air plenum, said variable geometry system being movable between an open position and a closed position; a movement of said variable geometry system between said open position and said closed position varying the distribution of compressed air to said combustion air supply portion and to said dilution or cooling air supply portion; and said distribution of compressed air being varied to said combustion air supply portion all being used to support combustion in said gas turbine engine.

13. The system of claim 12 wherein said combustor section further includes a combustor liner, said flow of combustion air being varied into said combustion air supply portion being used for cooling said combustor liner.

14. The system of claim 13 wherein said flow of compressed air passing from a hot end portion to a cold end portion of said combustor liner.

15. The system of claim 12 wherein said flow of compressed air being varied into said dilution or cooling supply portion being used for dilution.

16. The system of claim 12 wherein said combustion air supply portion being sealed from said dilution or cooling air supply portion.

* * * * *